US006879802B2

(12) United States Patent
Manleitner

(10) Patent No.: US 6,879,802 B2
(45) Date of Patent: Apr. 12, 2005

(54) PROCEDURE FOR FIXING OF TONER ON A PRINT MATERIAL AND FIXING DEVICE

(75) Inventor: Markus Peter Manleitner, Kiel (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/704,028

(22) Filed: Nov. 7, 2003

(65) Prior Publication Data

US 2004/0228666 A1 Nov. 18, 2004

(30) Foreign Application Priority Data

Nov. 19, 2002 (DE) ..... 102 53 744

(51) Int. Cl.[7] ..... G03G 15/20
(52) U.S. Cl. ..... 399/325; 399/341; 399/390
(58) Field of Search ..... 399/325, 341, 399/390

(56) References Cited

U.S. PATENT DOCUMENTS 5,639,582 A * 6/1997 Imai et al. ..... 430/108.3
5,970,272 A * 10/1999 Kobayashi et al. ..... 399/1
6,293,668 B1 * 9/2001 Kubby et al. ..... 347/101
2003/0007814 A1 * 1/2003 Richards ..... 399/341
2003/0031484 A1 * 2/2003 Mills ..... 399/341

FOREIGN PATENT DOCUMENTS

JP 59036262 2/1984 ..... G03G/13/20
JP 06149117 5/1994 ..... G03G/15/20

* cited by examiner

*Primary Examiner*—Arthur T. Grimley
*Assistant Examiner*—Peter Lee
(74) *Attorney, Agent, or Firm*—Lawrence P. Kessler

(57) ABSTRACT

An apparatus and procedure for the separation of a fixing roller from the print material, wherein, contamination of the print machine and the print material by release oil is avoided. A toner layer is applied to the printing material and, at minimum, a release material layer is directly applied to the printing material, upstream of the fixing roller, which makes possible reliable separation of the fixing roller from the print material.

6 Claims, 2 Drawing Sheets

PROCEDURE FOR FIXING OF TONER ON A PRINT MATERIAL AND FIXING DEVICE

FIELD OF THE INVENTION

The invention concerns fixing toner on print material wherein a layer applied directly to print material makes for reliable separation of fixing roller from print material.

BACKGROUND OF THE INVENTION

In the printing industry, various printing procedures are used, with variously configured printing machines. One factor common to the various printing procedures is that toner is applied to print material and then fixed to it. Various state-of-the-art solutions have been proposed for fixing toners to print material; one typical solution is to have a heated fixing roller come into rolling contact with the print material, and the toner is then fixed on the print material by pressure and heat. To facilitate detachment of the fixing roller from the print material, the fixing roller is provided with a release oil. The fixing oil is applied using rollers onto the fixing roller, with the rollers making contact with the fixing roller. Setting the dosage of the release oil depends critically on the roughness of the roller, as well as on the mechanical settings of blades, which impinge on the rollers and have an influence on the amount of release oil on the rollers.

Release oil collects on the fixing roller and on a back-up pressure roller, which is arrayed to oppose the fixing roller and provides a reverse pressure to the fixing roller. The print material is conveyed between the fixing roller and the back-up pressure roller. It is customary in cleaning release oil from the fixing roller and back-up pressure roller to affix a blade on the back-up pressure roller and cleaning roller, which come in rolling contact with the fixing roller and back-up pressure roller. The blade and the cleaning roller remove excess release oil from the fixing roller and the back-up pressure roller.

One disadvantage is that the release oil is provided in inexact doses, leading to excess release oil being transferred onto the print material. The release oil is visible on the print material and reveals itself in the gloss of the image on the print material. Excess release oil is transported through the printing machine, contaminating components of the printing machine and becoming deposited on it, particularly on the blade for the removal of release oil. From the components contaminated with release oil, the release oil can get onto the print material and cause defects on the print material, e.g. by smearing the image.

SUMMARY OF THE INVENTION

One object of the invention is to ensure that the fixing roller separates from the print material. A further object of the invention is to avoid contamination of the printing machine and the print material by release oil. A further object of the invention is to ensure a clean image, without defects, in a print machine. A further object of the invention is to obviate mechanical devices to apply release oil.

In one advantageous configuration of the invention, the amount of release oil of the layer is regulated depending on the desired gloss on the print material. In this way, the gloss of the image on the print material is adjusted in simple fashion.

In one advantageous embodiment, the amount of the release oil of the layer is regulated depending on the type of print material. Therefore, the invention is suited for situations where types of print material are changed, and ensures constant print image quality as well as a suitable, reliable removal of various print materials from the fixing roller with the print machine using differing types of print material. Further, contamination of the print machine by the release oil is avoided if a type of print material is used that requires less release oil than the previous type of print material for which the amount of release oil was suited.

It is advantageous to have the layer comprised of small capsules in which there is fixing material, thus improving the capacity to provide appropriate doses of the fixing material.

BRIEF DESCRIPTION OF THE DRAWINGS

In what follows, embodiment configurations of the invention are described in detail with the aid of the following diagrams.

DETAILED DESCRIPTION OF THE INVENTION

Figure 1:
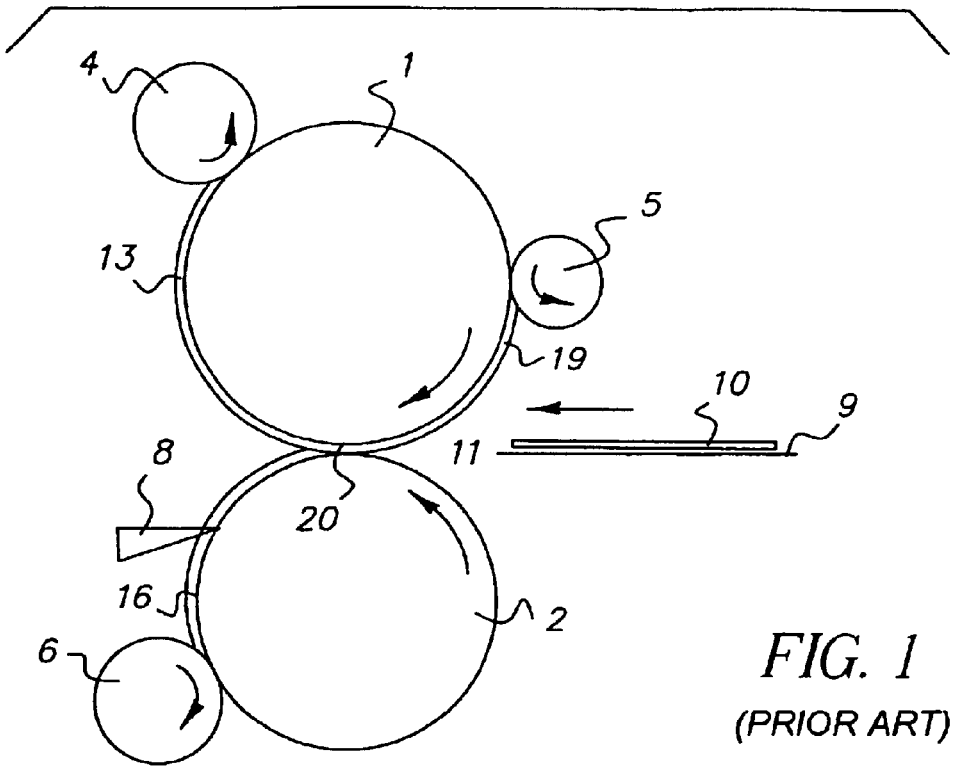
FIG. 1 (PRIOR ART)
FIG. 1 is a schematic view of a state-of-the-art fixing device for fixing toner on a print material.

FIG. 1 is a schematic view of the essential components of a fixing device in a state-of-the-art printing machine with a fixing roller 1, which turns about its axis in the manner shown. Set in opposition to fixing roller 1 is a back-up pressure roller 2, which touches fixing roller 1, and rolls in a direction opposite to it. Between fixing roller 1 and back-up pressure roller 2, a print material 9 is transported in the direction of the straight arrow. Print material 9 has a toner layer 10 on its upper side, which represents a print image. Toner layer 10 is transferred in printing stages before fixing on the print material 9; after transfer (application), the toner is not sufficiently fixed to the print material. Therefore, print material 9 with toner layer 10 is moved between fixing roller 1 and back-up pressure roller 2, thus causing toner layer 10 to be secured onto print material 9, aided by pressure and heat, and becoming fixed to it. After print material 9 with toner layer 10 moves away from fixing roller 1, toner layer 10 is securely attached to print material 9.

An oil application roller 5 adjoins fixing roller 1, which makes rolling contact with fixing roller 1 and transmits release oil onto fixing roller 1. Oil application roller 5 is fed from a container, which contains release oil. In the wake of oil application roller 5, viewed in the turning direction, there is consequently a release oil layer 19 on fixing roller 1. Release oil layer 19 in a segment 11 on fixing roller 1, which is defined as being from the line where oil application roller 5 touches fixing roller 1 to back-up pressure roller 2, has a certain thickness. On print material 9, fixing roller 1 imparts a certain quantity of release oil, to facilitate separation of fixing roller 1 from print material 9, and particularly of toner layer 10. Beyond the line of contact 20 between fixing roller 1 and back-up pressure roller 2, the layer 19 of release oil divides: part of the layer going onto the segment 13 on fixing roller 1, between line of contact 20 and the line of contact between fixing roller 1 and an initial cleaning roller 4, which touches fixing roller 1 and makes rolling contact with it; and part of layer 19 going onto segment 16 on back-up pressure roller 2, between line of contact 20 and a second cleaning roller 6, which adjoins back-up pressure roller 2 and makes rolling contact with it.

The initial cleaning roller 4 and second cleaning roller 6 remove excess release oil from fixing roller 1 and from back-up pressure roller 2. Additionally, a blade 8 operatively engages back-up pressure roller 2, which scrapes off excess release oil from back-up pressure roller 2. In segments 11, 13, and 16 on FIG. 1, a considerable amount of release oil is found on the surface of fixing roller 1 and back-up pressure roller 2. The remaining segments of fixing roller 1 and back-up pressure roller 2 have smaller amounts of release oil. What is problematic about this state-of-the-art version is that large segments on the rollers (fixing roller 1 and back-up pressure roller 2) are covered with relatively large quantities of release oil. Therefore, large amounts of release oil are deposited in the printing machine. If print material 9 comes in contact with the deposits of release oil (such as with deposits of release oil on blade 8), unintended streaks or defects appear on it, which impair the printed result.

Figure 2:
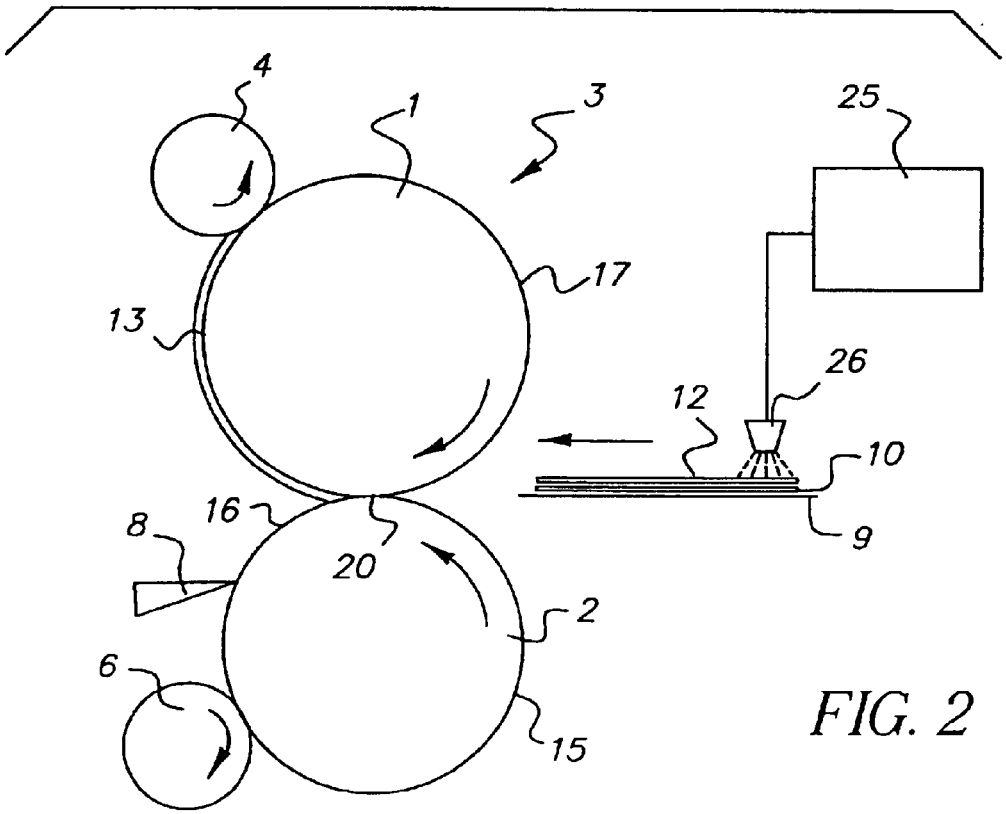
FIG. 2 is a schematic view of a fixing device in the embodiment configuration of the invention.

FIG. 2 is a schematic view of fixing device 3 in an embodiment configuration of the invention with a fixing roller 1 and an opposing back-up pressure roller 2. A fixing roller 1 is in juxtaposition with an initial cleaning roller 4, which makes rolling contact with fixing roller 1 and removes excess release oil from fixing roller 1. The release oil is a suitable material with high release characteristics, or in the alternative, contains toner with a release oil added. A second cleaning roller 6 is in juxtaposition with the back-up pressure roller 2, which makes rolling contact with reverse pressure roller 2 and removes excess release oil from back-up pressure roller 2. For the same purpose, blade 8 operatively engages on back-up pressure roller 2.

In contrast to FIG. 1, the embodiment configuration has no oil application roller 5, which transfers release oil onto fixing roller 1. Fixing roller 1 and back-up pressure roller 2 have a print material 9 fed to them on which at least one toner layer 10 is applied. On toner layer 10, upstream of fixing device 3, a layer 12 is directly applied which includes the release oil that ensures reliable separation of fixing roller 1 from the print material 9 with the toner layer 10. Layer 12 includes release material, for example release oil or toner. Another alternative is to have layer 12 include a toner that contains release oil, and toner layer 10 is dispensed with. In the latter case, there is a single layer 12 on print material 9, with toner layer 10 being dispensed with.

Additionally, it is possible to provide release material for layer 12 with a multiplicity of small capsules; e.g., microcapsules filled with release oil. When pressure is applied by fixing roller 1 at line of contact 20, at which print material 9 is contacted on one side by fixing roller 1 and on the other side by back-up pressure roller 2, the capsules burst open and the release oil is released. In another release-material option, the capsules may be released purely by thermal action at any desired location. In this case, the sheath of the capsule is burst by thermal radiation.

Layer 12 makes possible a considerably improved dosing of the release oil. As is evident from FIG. 2, those segments on the rollers (fixing roller 1 and back-up pressure roller 2), which carry large amounts of release oil, are very much smaller than in FIG. 1. Measurements have been taken revealing that only in area 13 on fixing roller 1, between contact line 20 and second cleaning roller 4, do relatively high quantities of release oil appear. On the remaining segments 15 and 16 between contact line 20 and cleaning roller 6, and between cleaning roller 6 and contact line 20 respectively, viewed in the direction of rotation, and in segment 17 of fixing roller 1 between initial cleaning roller 4 and contact line 20, viewed in the direction of rotation, only small quantities of release oil appear. Especially in segments 16 and 19, considerably smaller quantities of release oil appear than in the FIG. 1 state-of-the-art. The quantity of release oil and deposits of release oil are markedly reduced as compared to the state-of-the-art.

FIG. 2 shows schematically a control device 25 of the printing machine, in order to transfer layer 12 in controlled fashion directly onto print material 9 with toner layer 10 upstream of fixing device 3. Control device 25 receives printing data regarding a print order, such as type of print material and data contained in the image to be printed, entered via any suitable input into control device 25. By the print data, control device 25 guides the individual printing machine actions according to the print order, in the customary fashion.

Control device 25 is linked to a transfer device 26, which applies layer 12 onto print material 9. Transfer device 26 is activated by control device 25 at the moment that print material 9 comes beneath transfer device 26. The amount of release oil to be applied by transfer device 26 is regulated, depending on the desired gloss for the image to be printed on the print material 9. The more gloss that is desired, the more release oil is transferred by transfer device 26 onto print material 9. If provision is made for a different level of gloss for subsequent print material fed to fixing device 3 after passage of prior print material 9, control device 25 regulates transfer device 26 in such a fashion that a different quantity of release oil is transferred to the subsequent print material, thus producing a layer 12 that makes possible reliable removal of fixing roller 1 from such subsequent print material 9, while providing the desired gloss. The prior print material 9 and the subsequent print material can be of the same type of print material or differing types of print material. If a change is made in the type of print material in the printing machine, then an altered quantity of release oil may be required, because the consumption of release oil changes with the type of print material; different types of print material take differing quantities of release oil.

The release oil forms layer 12. However, layer 12 may not be limited to fixing oil, but rather can include toner; or, generally, layer 12 may contain a material that makes it possible for fixing roller 1 and back-up pressure roller 2 to reliably separate from print material 9. In addition, various types of print material result in various gloss effects with the amount of release oil kept constant. This state of affairs is managed by fixing device 3. In control device 25, the quantities of release oil that form layer 12 are assigned to different types of print materials. After the operator has input a print order into control device 25 of the printing machine (including data regarding the type or types of print material to be used in the print order), a quantity of release oil is assigned to the type of print material that is suited to that type of print material. Control device 25 regulates transfer device 26 in such a way that the amount of release oil released by transfer device 26 is adapted to the type of print material. In addition, the amount of release oil of the desired gloss is determined by transfer device 26, as described above.

Therefore, in control device 25, a quantity of release oil is assigned to a certain type of print material and a desired gloss of the type of print material stipulated. In this regard, the resultant gloss depends on the type of print material. For this purpose, control device 25 includes a data storage device in which prominent data is stored in a look-up table. Reacting to the assignment of a type of print material and a specified gloss to a quantity of release oil, transfer device 26 emits the appropriate quantity of release oil.

FIG. 2 shows a special option of transferring layer 12 of the fixing material. Additional options can be implemented, particularly corresponding to the printing procedure without a print form, the so-called non-impact printing procedure. For example, in an electrophotographic printing process, layer 12 is applied electrostatically. Layer 12, as well as toner layer 10 in the electrostatic printing process, are transferred, for example, by an imaging device onto an imaging cylinder, from which they are transferred directly onto print material 9, or onto an intermediate carrier and from that onto print material 9. In this example, toner layer 12 is configured so that it adheres onto the electrostatically charged surface of the imaging cylinder. In this way, layer 12 of the release oil, is covered, for example, by toner layer 10. Excess material is obviated, and contamination of the print material by release oil is avoided. Thereafter, toner layer 10 is fixed on print material 9, as described above.

Figure 3:
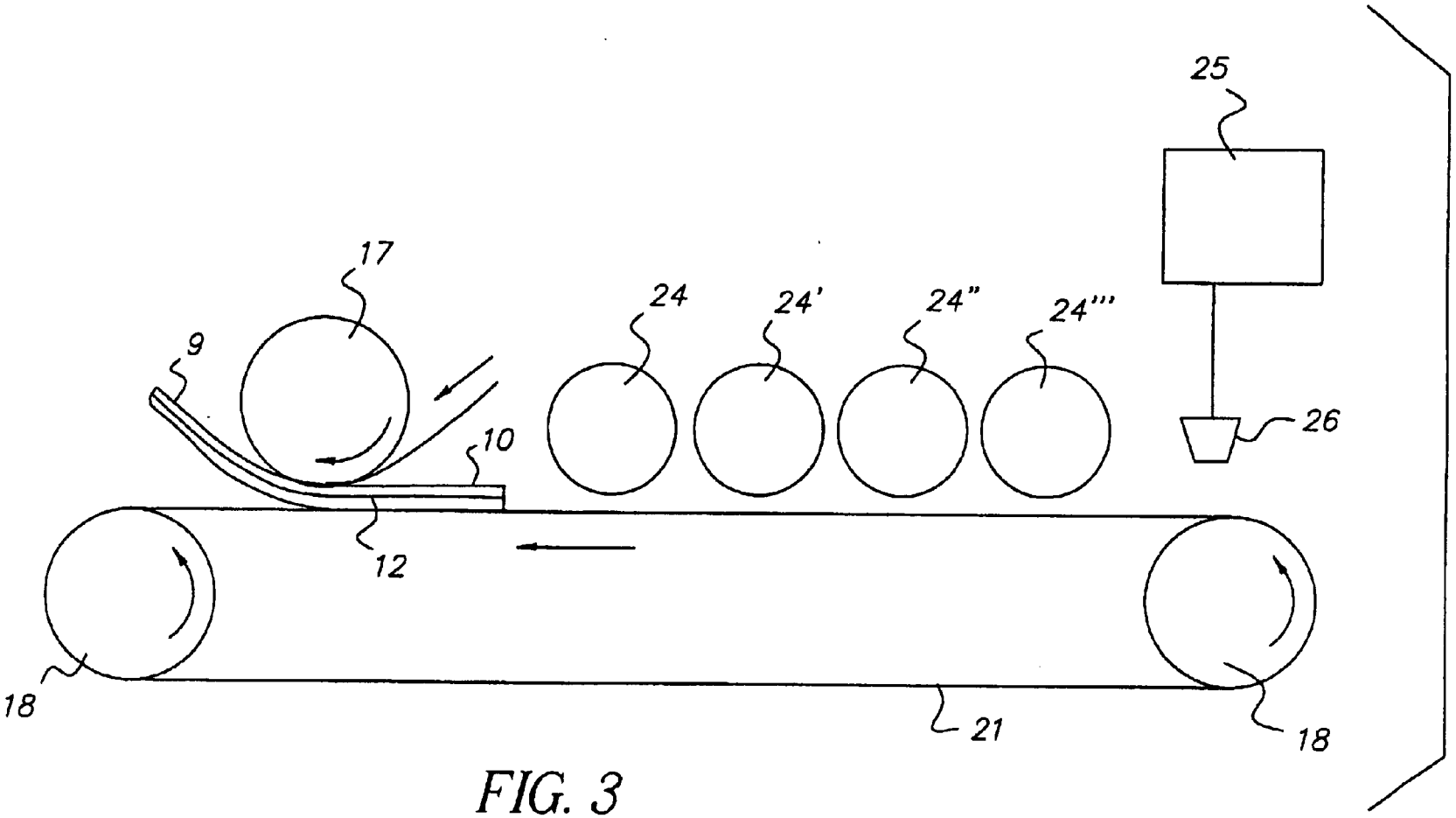
FIG. 3 shows a version of the invention in which the toner layer is applied on the layer on a transfer belt.

FIG. 3 shows an embodiment of the invention in which a transfer belt 21 is put in tension by support rollers 18, and is moved in the direction designated by the straight arrow. Transfer belt 21 essentially serves as an intermediate carrier of the image. Above transfer belt 21, transfer device 26 is situated, which applies layer 12 to transfer belt 21. Above transfer belt 21, several printing components are placed, which use print cylinders 24, 24', 24", 24'" to each apply a toner layer 10 with a different color to transfer belt 21. The individual toner layers 10 combine to form the overall image, but in FIG. 3 only one toner layer 10 is depicted.

Fixing roller 17 is placed above transfer belt 21 and in close proximity to it, behind transfer device 26 and the printing components with print cylinders 24, 24', 24", 24'" regarding the direction of transport of transfer belt 21. In this special example, fixing roller 17 transports print material 9, which moves past fixing roller 17 in the direction of the arrow on transfer belt 21, and touches it. It is here that toner layer 12, as well as layer 10, is applied to print material 9. It follows that layer 12 is now on print material 9 above toner layer 10, in accordance with FIGS. 1 and 2. In this case, layer 12 serves to assist in the separation of toner layer 10 from transfer belt 21.

In an additional operational step, toner layer 10 is fixed on print material 9, similar to what has been described in FIGS. 1 and 2. FIG. 3, describes an option by which toner layer 10 and layer 12 are applied onto print material 9; further options may be implemented, particularly the application of toner layer 10 and layer 12 from printing components 24, 24', 24", 24'" and transfer device 26 directly onto print material 9, with the latter moved by a transfer belt. In this case, first toner layer 10 and on it layer 12 of the release oil are applied onto print material 9, as depicted in FIGS. 1 and 2, as well as in FIG. 3, after the application of toner layer 10 and layer 12 by transfer belt 21 onto print material 9. The material is fixed as described in FIGS. 1 and 2.

The invention has been described in detail with particular reference to certain preferred embodiments thereof, but it will be understood that variations and modifications can be effected within the spirit and scope of the invention.

What is claimed is:

1. Procedure for fixing toner on a print material (9) with the help of a fixing roller (1), in which at least a toner layer (10) is applied to print material (9), wherein at least one layer (12) of release material is applied directly to print material (9), upstream of fixing operations which makes possible reliable separation of fixing roller (1) from print material (9) with toner layer (10).

2. Procedure according to claim 1, wherein the amount of release material of layer (12) is regulated depending on the desired gloss on print material (9).

3. Procedure according to claim 1, wherein the amount of release material of layer (12) is regulated depending on the type of print material.

4. Procedure according to claim 1, wherein the release material of layer (12) includes toner.

5. Fixing device (3) for fixing of toner on a print material (9) with the aid of a fixing roller (1), wherein a device (25) for control of application of layer (12) of release material directly onto print material (9), upstream of the fixing roller (1), which makes possible reliable separation of fixing roller (1) from print material (9) with toner layer (10).

6. Fixing device (3) according to claim 5, wherein release material of layer 12 includes small capsules of release oil.

* * * * *